US005231408A

United States Patent [19]

Nakase

[11] Patent Number: 5,231,408

[45] Date of Patent: Jul. 27, 1993

[54] GLASS ANTENNA AMPLIFIER

[75] Inventor: Kazuhiko Nakase, Tokyo, Japan

[73] Assignee: Harada Kogyo Kabushiki Kaisha, Tokyo, Japan

[21] Appl. No.: 839,740

[22] Filed: Feb. 19, 1992

Related U.S. Application Data

[63] Continuation of Ser. No. 496,187, Mar. 20, 1990, abandoned, which is a continuation of Ser. No. 17,848, Feb. 24, 1987, abandoned.

[30] Foreign Application Priority Data

Nov. 21, 1986 [JP] Japan ..... 61-278211

[51] Int. Cl.[5] ..... H01Q 1/02

[52] U.S. Cl. ..... 343/704; 343/713; 455/286

[58] Field of Search ..... 343/704, 713, 745, 850; 455/286; 219/203

[56] References Cited

U.S. PATENT DOCUMENTS 4,063,247 12/1977 Sakurai et al. ..... 343/704
4,086,594 4/1978 Kropielnicki et al. ..... 343/713
4,422,077 12/1983 Kropielnicki ..... 343/704
4,439,771 3/1984 Kume et al. ..... 343/704
4,564,843 1/1986 Cooper ..... 343/745
4,583,097 4/1986 Kropielnicki ..... 343/704
4,654,669 3/1987 Kropielnicki et al. ..... 343/704
4,757,277 7/1988 Nakase et al. ..... 455/286

FOREIGN PATENT DOCUMENTS 2735278 3/1977 Fed. Rep. of Germany ..... 343/704

*Primary Examiner*—Rolf Hille
*Assistant Examiner*—Hoanganh Le
*Attorney, Agent, or Firm*—Koda and Androlia

[57] ABSTRACT

A compensating/amplifying device for a window glass antenna for an automobile. The device utilizes heating wires, which remove fog formed on the automobile window glass, as an antenna and includes band-pass filter coils interposed between a battery of the automobile and the heating wires, and the band-pass filter coils and a floating capacity between the heating wires and ground are used as a part of an input band-pass filter of a compensating amplifier.

5 Claims, 3 Drawing Sheets

GLASS ANTENNA AMPLIFIER

This is a continuation of application Ser. No. 496,187, filed Mar. 20, 1990, now abandoned which is a continuation of application Ser. No. 017,848, filed Feb. 24, 1987, now abandoned.

BACKGROUND OF THE INVENTION

1. Field of the Invention

The present invention relates to a glass antenna amplifier, and more particularly to a compensating/amplifying device which utilizes a heating element incorporated in the glass of automobile windows as an antenna.

2. Prior Art

A device for using a heating element, which is incorporated in the automobile window glass for removing fog formed on the glass, as an antenna is disclosed in Japanese Laid-Open Patent Number 52-64,257. (which corresponds to U.S. Pat. No. 4,086,594 and U.K. Patent No. 1,520,030)

As illustrated in FIG. 5, in this prior art, a blocking circuit which includes a radio signal blocking coil 9 and a choke 7 for inhibiting interference is interposed between heating wires H and an automobile battery B. The radio signals, such as radio broadcasting signals, are picked up between the heating wires H and the blocking coil 9, and the picked-up signals are amplified by an auxiliary amplifier 13.

In the above prior art, the inductance of the blocking coil 9 is set at about 2 mH. Accordingly, high frequency signals received by the heating wires, which are used as an antenna, do not flow to ground but are sent to a radio receiver, etc. (not shown in the drawings) via the auxiliary amplifier 13.

The blocking coil 9 is wound on pot cores which have no air gaps. Also, since a direct current flowing through the heating wires H is about 10 A, relatively thick wire is required for the direct current to flow through the wires. Thus, the problem is that the size of the blocking coil 9 must be large enough to obtain the necessary inductance, and this results in an enlargement of the overall size of the compensating amplifier.

Further, in the above prior art, pot cores are used in order to render the overall size of the amplifier as small as possible. However, the pot cores are expensive, and a mirror-grinding must be done between the surfaces of the pot cores in order to eliminate the air gaps. This increases the manufacturing cost of the amplifier.

SUMMARY OF THE INVENTION

The present invention was made in view of the above described problems of the prior art.

The primary object of the present invention is to provide a compensating/amplifying device for a glass window antenna which is small in size and low in manufacturing cost.

In keeping with the principles of this invention, the above objects are accomplished by a unique structure for a compensating/amplifying device for glass antennas, which uses the heating element (heating wires) for removing the fog formed on the window glass of an automobile as an antenna element, wherein band-pass filter coils are interposed between a direct current power supply of the automobile and the heating element such that a floating capacity between the heating element and ground and the band-pass filter coils can be used as a part of an input band-pass filter of a compensating amplifier.

BRIEF DESCRIPTION OF THE DRAWINGS

The above mentioned features and objects of the present invention will become more apparent with reference to the following descriptions taken in conjunction with the accompanying drawings, wherein like reference numerals denote like elements, and in which.

DETAILED DESCRIPTION OF THE INVENTION

Figure 1:
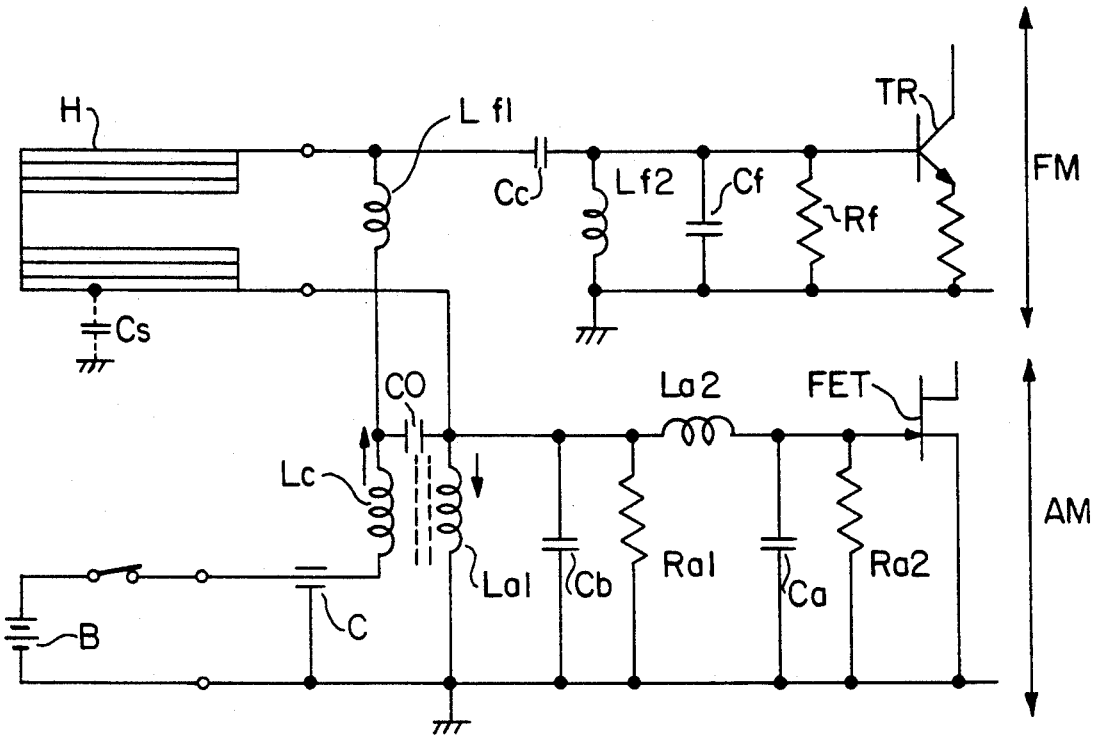
FIG. 1 is a circuit diagram of one embodiment of the present invention.

FIG. 1 is a circuit diagram showing one embodiment of the present invention.

In this embodiment, coils are interposed between heating wires or heating element H and a battery or power supply B. This structure is the same as the prior art mentioned earlier. However, in the embodiment of this invention, the coils are not used for blocking the high frequency component; in other words, the coils are not used as a choke. Instead, the coils are used as a part of a band-pass filter, and this is how the present invention differs from the prior art.

Between the heating wires H and the battery B is provided a band-pass filter coil La1 for AM signals, a canceling coil Lc which cancels out direct current magnetization caused by the band-pass filter coil La1, and a band-pass filter coil Lf1 for FM waves. The inductance of the band-pass filter coil La1 is set at 1 mH or less. A feed-through capacitor C for removing power supply noise is interposed between the canceling coil Lc and the battery B. Floating capacity Cs is the capacity between the heating wire H and ground.

A circuit for the FM signals comprises a coupling condenser Cc, a coil Lf2, a condenser Cf, a resistor Rf, and a transistor TR. The band-pass filter coil Lf1 and the floating capacity Cs are used as a part of an input band-pass filter of a compensating amplifier for FM band signals.

On the other hand, a circuit for AM signals comprises a condenser CO, an additional capacity Cb, a coil La2, a condenser Ca, resistors Ra1 and Ra2, and an FET (field effect transistor). The condenser CO connects the band-pass filter coil La1 and the canceling coil Lc at high frequency. The band-pass filter coil La1, the floating capacity Cs, and the additional capacity Cb are used as a part of an input band-pass filter of a compensating amplifier for AM band signals.

The functions of the above embodiment will be explained in detail below.

Figure 2:
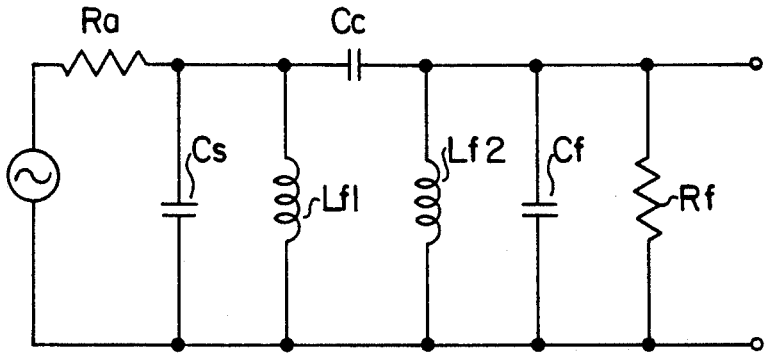
FIG. 2 is an FM equivalent circuit diagram used in the above embodiment.

FIG. 2 shows an FM equivalent circuit in the above embodiment.

In FIG. 2, Ra is an antenna resistor. The FM equivalent circuit is a double tuning circuit and includes a primary tuning circuit and a secondary tuning circuit. The primary tuning circuit comprises a band-pass filter coil Lf1 which is of an air-core type and a floating capacity Cs. The secondary tuning circuit comprises an inductance Lf2 and a capacitor Cf.

In the prior art circuit, floating capacity Cs caused a loss in the FM wave component. However, in the present invention, since the floating capacity Cs is structured as a part of the band-pass filter, losses caused by the floating capacity are small. Further, since the floating capacity works as a band-pass filter, the gain within such a band can be raised by several Decibels (dB's) when compared with the prior art.

Figure 3:
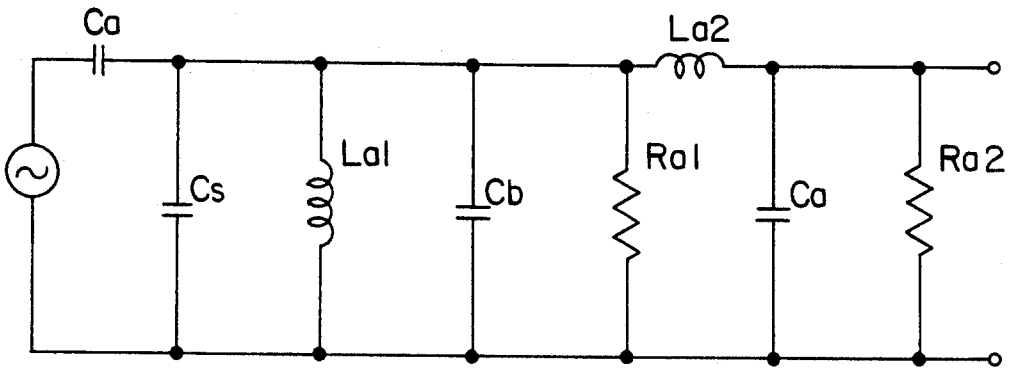
FIG. 3 is an AM equivalent circuit diagram used in the above embodiment.

FIG. 3 shows an AM equivalent circuit in the above embodiment.

This circuit comprises a primary tuning circuit and a secondary tuning circuit. The primary tuning circuit is a high pass filter and includes a band-pass filter coil La1, a floating capacity Cs, and an additional capacity Cb which adjusts the tuning frequencies. The secondary tuning circuit is a low-pass filter and includes an inductance La2 and a capacitor Ca.

As seen from the above, since the floating capacity Cs is used as a part of the band-pass filter even within the AM wave bands, losses caused by the floating capacity Cs can be reduced. Also, since the floating capacity functions as a band-pass filter, the gain can be raised as much as several dB's even within the AM wave bands when compared with the prior art.

Figures 1, 4:
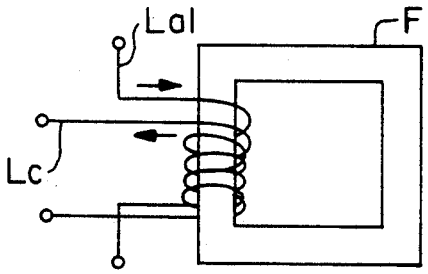
FIGS. 4(1) and 4(2) respectively shows the manner in which the coils are wound in the above embodiment.
Figures 2, 4:
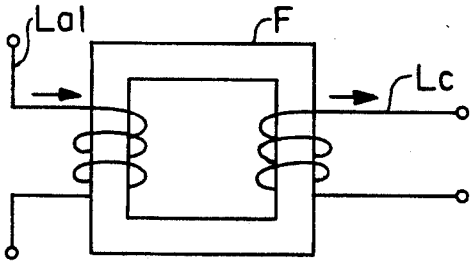
Figure 5:
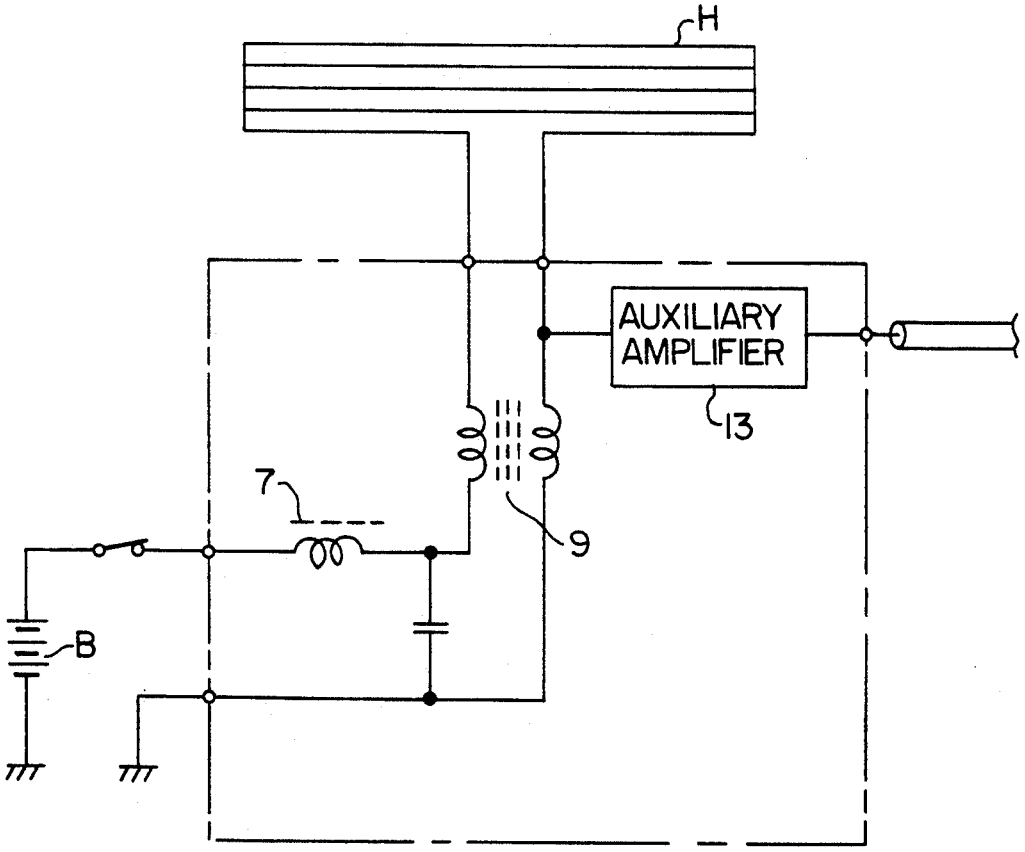
FIG. 5 PRIOR ART
FIG. 5 is a circuit diagram of the prior art device.

FIGS. 4(1) and 4(2) respectively illustrates the manner of winding the band-pass filter coil La1 and the canceling coil Lc on a ferrite core F.

In FIG. 4(1), the band-pass filter coil La1 and the canceling coil Lc are provided as a bifilar winding. In FIG. 4(2), they are wound separately.

Direct current from the battery B flows through the band-pass filter coil La1, causing direct current magnetization and saturation in the ferrite core F. Thus, the inductance is lowered below the desired level. In order to prevent this, the canceling coil Lc is wound such that the direction and the magnitude of the magnetic field of the canceling coil Lc are opposite to those of the band-pass filter coil La1.

As mentioned above, in the present invention, the band-pass filter coil La1 is used as a part of a band-pass filter and not as a choke coil. Accordingly, it does not matter that high frequency signals received by the heating wires, which are used as an antenna, flow into the ground. This feature significantly differenciates the present invention from the prior art. (In the prior art cited above, the inductance of the coil 9 is set large so that the radio signals do not flow into the ground.)

As can be understood from the above description, according to the present invention, it is not necessary to set the inductance value of the band-pass filter as high as in the prior art. As a result, a torroidal core rather than a pot core can be used in this invention. By using the torroidal core, the device can be manufactured at a lower cost than the prior art.

Further, since both AM and FM coils can be small in size, the overall size of the entire device can also be small.

In the above embodiment, the feed-through condenser C inhibits the power supply noise caused by the battery B from entering into the AM curcuit or FM circuit. The additional capacity Cb, together with the band-pass filter coil La1, not only comprises a band-pass filter for AM signals but also functions as a by-pass condenser for the FM circuit. Thus, a stable tuning characteristic is obtainable without getting any influence from the AM circuit.

The core used in the above embodiment for the windings of the band-pass filter coil La1 and the canceling coil Lc is not limited to the torroidal type, and the pot type core can also be used. With the use of the pot type core, the size of the entire device can be further reduced.

As mentioned in detail in the above, according to the present invention, the overall size of the compensating-/amplifying device for the glass antenna can be reduced, and this is advantageous in view of the lower cost of manufacturing same.

I claim:

1. A compensated/amplifying device for glass antennas which uses a heating element for removing fog on the glass of a vehicle window as an antenna element, comprising:

band-pass filter coils for AM signals and FM signals interposed between a direct current power supply of said vehicle and said heating element, said band-pass filter coils comprising an FM band-pass filters coil, an AM band-pass filters coil and a canceling coil each separately wound, said canceling coil being wound such that a direction and magnitude of a magnetic field created from direct current power supply passing through said canceling coil are opposite to a direction and magnitude of a magnetic field of said AM band-pass coil;

an amplifier means coupled to said band-pass filter coils; and a floating capacity formed between said heating element and ground and provided in parallel with said band-pass filter coils, said floating capacity and said band-pass filter coils forming input AM and FM band-pass filters for said amplifier means.

2. A device according to claim 1, wherein at least one of said AM and FM band-pass filter coils is wound around a ferrite core which is of a pot type.

3. A device according to claim 1, wherein said input FM band-pass filter of said compensating amplifier is a band-pass filter for receiving FM band signals and includes a double tuning circuit comprising a primary tuning circuit and a second tuning circuit, said primary tuning circuit including said FM band-pass filter coil which is of an aircore type and said secondary tuning circuit including an inductance and capacitor.

4. A device according to claim 1, wherein said input AM band-pass filter of said compensating amplifier is a band-pass filter for receiving AM band signals and comprising a primary tuning circuit and a secondary tuning circuit, said primary tuning circuit is a high-pass filter including said AM band-pass filter coil, said floating capacity, and an additional capacity for adjusting tuning frequency, and said secondary tuning circuit is a low-pass filter including an inductance and a capacitor.

5. A device according to claim 1, wherein at least one of said AM and FM band-pass filter coils is wound around a ferrite core which is of a torroidal type.

* * * * *